US011168494B2

(12) United States Patent
Compton

(10) Patent No.: US 11,168,494 B2
(45) Date of Patent: Nov. 9, 2021

(54) DOOR POSITION SENSOR FOR MORTISE LOCKS UTILIZING EXISTING AUXILIARY OR MAIN LATCH OPERATION

(71) Applicant: Schlage Lock Company LLC, Carmel, IN (US)

(72) Inventor: Daniel J. Compton, Colorado Springs, CO (US)

(73) Assignee: Schlage Lock Company LLC, Carmel, IN (US)

( * ) Notice: Subject to any disclaimer, the term of this patent is extended or adjusted under 35 U.S.C. 154(b) by 776 days.

(21) Appl. No.: 15/985,962

(22) Filed: May 22, 2018

(65) Prior Publication Data

US 2018/0340352 A1 Nov. 29, 2018

Related U.S. Application Data

(60) Provisional application No. 62/511,529, filed on May 26, 2017.

(51) Int. Cl.
*E05B 47/06* (2006.01)
*E05B 47/00* (2006.01)
(Continued)

(52) U.S. Cl.
CPC ..... *E05B 47/0611* (2013.01); *E05B 47/00* (2013.01); *E05B 47/0046* (2013.01);
(Continued)

(58) Field of Classification Search
CPC .. E05B 17/22; E05B 47/00; E05B 2045/0665; E05B 2047/0069; E05B 47/0038; E05B 65/108; E05B 45/083; E05B 45/12; E05B 2047/0067; E05B 47/0002; E05B 47/026; E05B 63/08; E05B 47/0611; E05B 47/0046; E05B 55/00; E05B 47/0012; E05B 2047/0068; Y10T 292/11; Y10T 70/7057; Y10T 24/32;
(Continued)

(56) References Cited

U.S. PATENT DOCUMENTS 5,925,861 A * 7/1999 Fromberg ..... E05B 45/12 200/61.67
6,318,138 B1 11/2001 Mathews et al.
(Continued)

*Primary Examiner* — Mark A Williams
(74) *Attorney, Agent, or Firm* — Taft Stettinius & Hollister LLP

(57) ABSTRACT

A mortise lock assembly is disclosed that enables a position of a door associated with the mortise lock assembly to be determined despite whether a deadbolt is in a retracted state or an engaged state. An auxiliary latch assembly transitions between an engaged state and a retracted state. A main latch assembly may also transition between an engaged state and a retracted state. A magnetic field sensing device that is positioned on the auxiliary latch assembly detects a magnetic field generated by a magnetic field generating device positioned on a door strike. The magnetic field sensing device is positioned on the auxiliary latch assembly such that the magnetic field sensing device is aligned with the magnetic field generating device positioned on the door strike when the door is in a closed position. The magnetic field sensing device may also be positioned on the main latch assembly in a similar manner.

20 Claims, 9 Drawing Sheets

(51) Int. Cl.
*E05B 55/00* (2006.01)
*E05B 45/06* (2006.01)

(52) U.S. Cl.
CPC ..... *E05B 55/00* (2013.01); *E05B 47/0012* (2013.01); *E05B 2045/0665* (2013.01); *E05B 2047/0068* (2013.01); *E05B 2047/0069* (2013.01)

(58) Field of Classification Search
CPC ..... Y10T 70/7904; Y10T 70/8027; E05C 19/166; E05C 17/56; E05C 19/16; E05C 19/168
See application file for complete search history.

(56) References Cited

U.S. PATENT DOCUMENTS 6,441,735 B1 8/2002 Marko et al.
6,539,755 B1 * 4/2003 Bruwer ..... E05B 47/0012 292/165
8,686,869 B2 4/2014 Sharma et al.
9,187,929 B2 11/2015 Webb et al.
9,631,920 B2 4/2017 Goldenson
2006/0192396 A1 * 8/2006 Frolov ..... E05C 1/163 292/169
2009/0090148 A1 * 4/2009 Kollin ..... E05B 45/083 70/263
2010/0218569 A1 * 9/2010 Hunt ..... E05C 19/166 70/263
2011/0203331 A1 * 8/2011 Picard ..... E05B 47/0046 70/91
2012/0299314 A1 * 11/2012 Jiang ..... E05B 45/083 292/137
2014/0292001 A1 * 10/2014 Nunez ..... E05B 47/0038 292/164
2015/0330140 A1 * 11/2015 Kincaid ..... G08B 13/08 324/207.12
2016/0145904 A1 * 5/2016 Lowder ..... E05B 47/00 340/542
2018/0340352 A1 * 11/2018 Compton ..... E05B 47/0611
2019/0383060 A1 * 12/2019 Lien ..... E05B 17/044
2021/0054655 A1 * 2/2021 Cheng ..... E05B 65/087

* cited by examiner

DOOR POSITION SENSOR FOR MORTISE LOCKS UTILIZING EXISTING AUXILIARY OR MAIN LATCH OPERATION

CROSS-REFERENCE TO RELATED APPLICATIONS

The present application is a Nonprovisional Application, which claims the benefit of Provisional Appl. No. 62/511,529, filed May 26, 2017, which is incorporated herein by reference in its entirety.

BACKGROUND

Field of Disclosure

The present disclosure generally relates to door position sensing and specifically to door position sensing in mortise locks.

Related Art

Conventional lock assemblies determine the status of the position of the door regarding whether the door is in a closed state or an open state is determined based on a door positioning feature. Conventional lock assemblies include a door position sensor that is positioned on a printed circuit board assembly (PCBA) that is installed in the lock assembly as well as a magnet that is installed between the strike and the door frame. The magnetometer then detects the magnetic field generated by the magnet when the door is in the closed position and fails to detect the magnetic field of the magnet when the door is in the open position. The position of the door is then indicated as being in the closed position when the magnetic field is detected and as being in the open position when the magnetic field is not detected.

However, mortise lock assemblies include a significant amount of metal as compared to other conventional lock assemblies. The conventional positioning of the magnetometer on the PCBA that is tucked inside the mortise lock assembly fails to detect the magnetic field generated by the magnet installed on the strike when in the closed position due to the significant amount of metal that is positioned between the magnetometer and the magnet. Thus, failing to accurately indicate that the door is in the closed position due to the inability to detect the magnetic field generated by the magnet when in the closed position.

Conventional mortise lock assemblies position the magnetometer in the position typically occupied by the deadbolt to position the door position sensor closer to the magnet installed on the strike to increase the likelihood that the magnetometer detects the magnetic field generated by the magnet when in the closed position. In doing so, the deadbolt is removed from the conventional mortise lock assembly and is no longer available to the user. Further, the door position sensor positioned in the deadbolt location may still not detect the magnetic field generated by the magnet when in the closed position and additional door prep may be required by the user to ensure that the door position sensor detects the magnetic field generated by the magnet when the door position sensor is positioned in the deadbolt location.

BRIEF SUMMARY

Embodiments of the present disclosure relate to positioning a door positioning sensor in a mortise lock assembly such that the door positioning sensor accurately determines whether the door is in the open position or the closed position and in doing so accommodating for the increased amount of metal included in mortise lock assemblies. In an embodiment, a mortise lock assembly that is associated with a door includes an auxiliary latch assembly that is configured to transition between an engaged state and a retracted state. The mortise lock assembly also includes a magnetic field sensing device that is positioned on the auxiliary latch assembly and is configured to detect a magnetic field generated by a magnetic field generating device positioned on a door strike. The magnetic field sensing device positioned on the auxiliary latch assembly is aligned with the magnetic field generating device positioned on the door strike when the door is in a closed position.

In an embodiment, a method determines a position of a door that includes a mortise lock. The mortise lock is transitioned by an auxiliary latch assembly between an engaged state and a retracted state. A magnetic field generated by a magnetic field generating device positioned on a door strike is detected by a magnetic field sensing device that is positioned on the auxiliary latch assembly. The magnetic field sensing device positioned on the auxiliary latch assembly is aligned with the magnetic field generating device positioned on the door strike when the door is in a closed position.

In an embodiment, a mortise lock assembly that is associated with a door includes a main latch assembly that is configured to transition between an engaged state and a retracted lock state. A magnetic field sensing device that is positioned on the main latch assembly is configured to detect a magnetic field generated by a magnetic field generating device positioned on a door strike. The magnetic field sensing device positioned on the main latch assembly is aligned with the magnetic field generating device positioned on the door strike when the door strike is in a closed position.

BRIEF DESCRIPTION OF THE DRAWINGS/FIGURES

Embodiments of the present disclosure are described with reference to the accompanying drawings. In the drawings, like reference numerals indicate identical or functionally similar elements. Additionally, the left most digit(s) of a reference number identifies the drawing in which the reference number first appears.

DETAILED DESCRIPTION OF THE PRESENT DISCLOSURE

Figure 1:
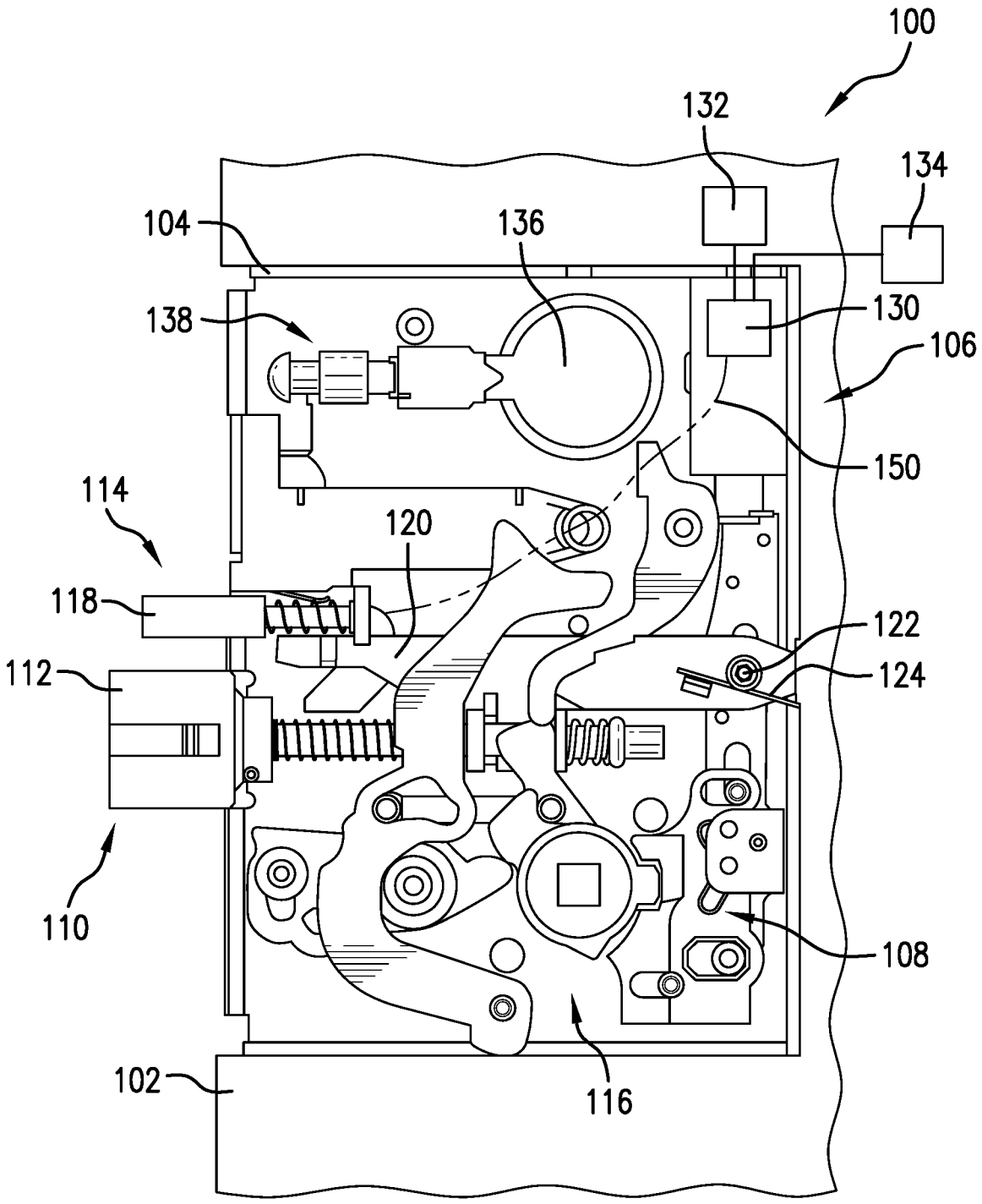
FIG. 1 is a top-elevational view of a mortise lock assembly.

The following Detailed Description refers to accompanying drawings to illustrate exemplary embodiments consistent with the present disclosure. References in the Detailed Description to "one exemplary embodiment," an "exemplary embodiment," an "example exemplary embodiment," etc., indicate the exemplary embodiment described may include a particular feature, structure, or characteristic, but every exemplary embodiment may not necessarily include the particular feature, structure, or characteristic. Moreover, such phrases are not necessarily referring to the same exemplary embodiment. Further, when a particular feature, structure, or characteristic may be described in connection with an exemplary embodiment, it is within the knowledge of those skilled in the art(s) to effect such feature, structure, or characteristic in connection with other exemplary embodiments whether or not explicitly described.

The exemplary embodiments described herein are provided for illustrative purposes, and are not limiting. Other exemplary embodiments are possible, and modifications may be made to the exemplary embodiments within the spirit and scope of the present disclosure. Therefore, the Detailed Description is not meant to limit the present disclosure. Rather, the scope of the present disclosure is defined only in accordance with the following claims and their equivalents.

Embodiments of the present disclosure may be implemented in hardware, firmware, software, or any combination thereof. Embodiments of the present disclosure may also be implemented as instructions applied by a machine-readable medium, which may be read and executed by one or more processors. A machine-readable medium may include any mechanism for storing or transmitting information in a form readable by a machine (e.g., a computing device). For example, a machine-readable medium may include read only memory ("ROM"), random access memory ("RAM"), magnetic disk storage media, optical storage media, flash memory devices, electrical optical, acoustical or other forms of propagated signals (e.g., carrier waves, infrared signals, digital signals, etc.), and others. Further firmware, software routines, and instructions may be described herein as performing certain actions. However, it should be appreciated that such descriptions are merely for convenience and that such actions in fact result from computing devices, processors, controllers, or other devices executing the firmware, software, routines, instructions, etc.

For purposes of this discussion, each of the various components discussed may be considered a module, and the term "module" shall be understood to include at least one software, firmware, and hardware (such as one or more circuit, microchip, or device, or any combination thereof), and any combination thereof. In addition, it will be understood that each module may include one, or more than one, component within an actual device, and each component that forms a part of the described module may function either cooperatively or independently from any other component forming a part of the module. Conversely, multiple modules described herein may represent a single component within an actual device. Further, components within a module may be in a single device or distributed among multiple devices in a wired or wireless manner.

The following Detailed Description of the exemplary embodiments will so fully reveal the general nature of the present disclosure that others can, by applying knowledge of those skilled in the relevant art(s), readily modify and/or adapt for various applications such exemplary embodiments, without undue experimentation, without departing from the spirit and scope of the present disclosure. Therefore, such adaptations and modifications are intended to be within the meaning and plurality of equivalents of the exemplary embodiments based upon the teaching and guidance presented herein. It is to be understood that the phraseology or terminology herein for the purpose of description and not of limitation, such that the terminology or phraseology of the present specification is to be interpreted by those skilled in the relevant art(s) in light of the teachings herein.

Mortise Lock Assembly

FIG. 1 is an elevational view of a mortise lock assembly 100 configured for mounting in a door 102. The mortise lock assembly 100 includes a case 104 that houses a drive assembly 106, a locking member or catch 108 driven by the drive assembly 106, a latch assembly 110 including a retractable main latch bolt 112, an auxiliary latch assembly 114, and a transmission assembly 116 connected to the latch assembly 110 and operable to retract the main latch bolt 112. The lock assembly 100 further includes a cover plate (not illustrated), which covers components of the lock assembly 100 within the case 104.

The mortise lock assembly 100 may be installed in the door 102, which may have a secured/inner side facing a secured/inner environment (e.g., the interior of a building) and unsecured/outer side facing an unsecured/outer environment. In some embodiments, it should be appreciated that the unsecured/outer side may face another secured environment (e.g., secured by virtue of another access control device/system). Additionally, one or more manual actuators such as handles, knobs, or levers (not illustrated) may be coupled to the transmission assembly 116. In operation, the drive assembly 106 moves the catch 108 between a locking position and an unlocking position to define locked and unlocked states of the lock assembly 100. With the catch 108 in the unlocking position, an outer handle is free to rotate, and rotation of the outer handle is transmitted through the transmission assembly 116 to cause retraction of the latch assembly 110. When in the locking position, the catch 108 engages the transmission 116 such that rotation of the outer handle is prevented, and the outer handle is not operable to retract the latch assembly 110.

The auxiliary latch assembly 114 includes an auxiliary latch 118 slidingly mounted to the case 104, a deadlocking member 120 pivotably mounted on a post 122, and a biasing member such as a torsion spring 124 rotationally biasing the auxiliary latch 118 toward the transmission assembly 116. As the door 102 is closed, the auxiliary latch 118 is depressed to a retracted position via contact with the door frame or door strike located at the door frame. As the auxiliary latch 118 retracts, the spring 124 urges the auxiliary latch 118 to a blocking position, wherein the free end of the auxiliary latch 118 is aligned with the main latch bolt 112. In this position, the auxiliary latch 118 prevents the main latch bolt 112 from being forced inwardly by an externally-applied force, thereby deadlocking the main latch bolt 112.

The lock assembly 100 also includes a controller 130 which controls operation of the drive assembly 106 to move the catch 108 between the locking and unlocking positions. The controller 130 may be in communication with a user interface 132, such as a keypad or credential reader which may be mounted on or adjacent to the door 102. The controller 130 may additionally, or alternatively, be in communication with a control system 134. In operation, the controller 130 may maintain the lock assembly 100 in the locked state, and may operate the drive assembly to move the catch 108 to the unlocked position in response to an authorized unlock command from the user interface 132 and/or the control system 134. The lock assembly 100 further includes an aperture 136 configured to contain a key cylinder (not shown). A screw assembly 138 engages the key cylinder to hold the cylinder within the aperture 136.

The controller 130 may determine a position of the door based on a magnetic field sensing device that detects a magnetic field generated by a magnetic field generating device. The magnetic field sensing device may be positioned in the lock assembly 100 such that the magnetic field sensing device detects the magnetic field generated by the magnetic field generating device positioned on a door strike. The magnetic field generating device positioned on the door strike may enable the magnetic field generating device to be positioned in a stationary position relative to the door 102 such that the magnetic field generating device remains stationary positioned while the door 102 rotates between the open state and the closed state. The magnetic field generating device may be a permanent magnet, an electromagnet, and/or any type of magnetic field generating device that generates a magnetic field that may be detected by the magnetic field sensing device that will be apparent to those skilled in the relevant art(s) without departing from the spirit and scope of the disclosure.

The magnetic field sensing device may be positioned in the lock assembly 100 such that the magnetic field sensing device changes position as the door 102 changes position. The magnetic field sensing device may also be positioned in the lock assembly 100 such that the magnetic field sensing device detects the magnetic field generated by the magnetic field generating device positioned on the door strike when the door 102 is in the closed position. The magnetic field sensing device may detect the magnetic field generated by the magnetic field generating device when the door 102 is in the closed position due to the magnetic field sensing device being within a sufficient range of the magnetic field generating device to detect the magnetic field generated by the magnetic field generating device when the door 102 is in the closed position. As the door 102 transitions from the closed position to the open position, the magnetic field sensing device may no longer be within sufficient range to detect the magnetic field generated by the magnetic field generating device and thus fails to detect the magnetic field when the door 102 transitions to the open position.

The controller 130 may determine the position of the door 102 based on whether the magnetic field sensing device detects the magnetic field generated by the magnetic field generating device. The magnetic field sensing device may indicate to the controller 130 that the magnetic field sensing device is detecting the magnetic field generated by the magnetic field generating device. As noted above, the magnetic field sensing device may detect the magnetic field generated by the magnetic field generating device when the magnetic field sensing device is within sufficient range to detect the magnetic field. Due to the positioning of the magnetic field sensing device on the lock assembly 100, the magnetic field sensing device may detect the magnetic field when the door 102 is in the closed position. Thus, the controller 130 may determine that the door 102 is in the closed position when the magnetic field sensing device indicates that the magnetic field sensing device detects the magnetic field generated by the magnetic field generating device.

The magnetic field sensing device may also indicate to the controller 130 that the magnetic field sensing device is no longer detecting the magnetic field generated by the magnetic field generating device. As noted above, the magnetic field sensing device may no longer detect the magnetic field generated by the magnetic field generating device when the magnetic field sensing device is no longer within sufficient range to detect the magnetic field. Due to the positioning of the magnetic field sensing device on the lock assembly 100, the magnetic field sensing device may no longer detect the magnetic field when the door 102 is in the open position. Thus, the controller 130 may determine that the door 102 is in the open position when the magnetic field sensing device indicates that magnetic field sensing device no longer detects the magnetic field generated by the magnetic field generating device. The magnetic field sensing device may be a magnetometer, a reed switch, a hall effect sensor, and/or any other type of magnetic field sensing device that is capable of detecting the magnetic field generated by the magnetic field generating device when the door 102 is in the closed position that will be apparent to those skilled in the relevant art(s) without departing from the spirit and scope of the disclosure.

Figure 3:
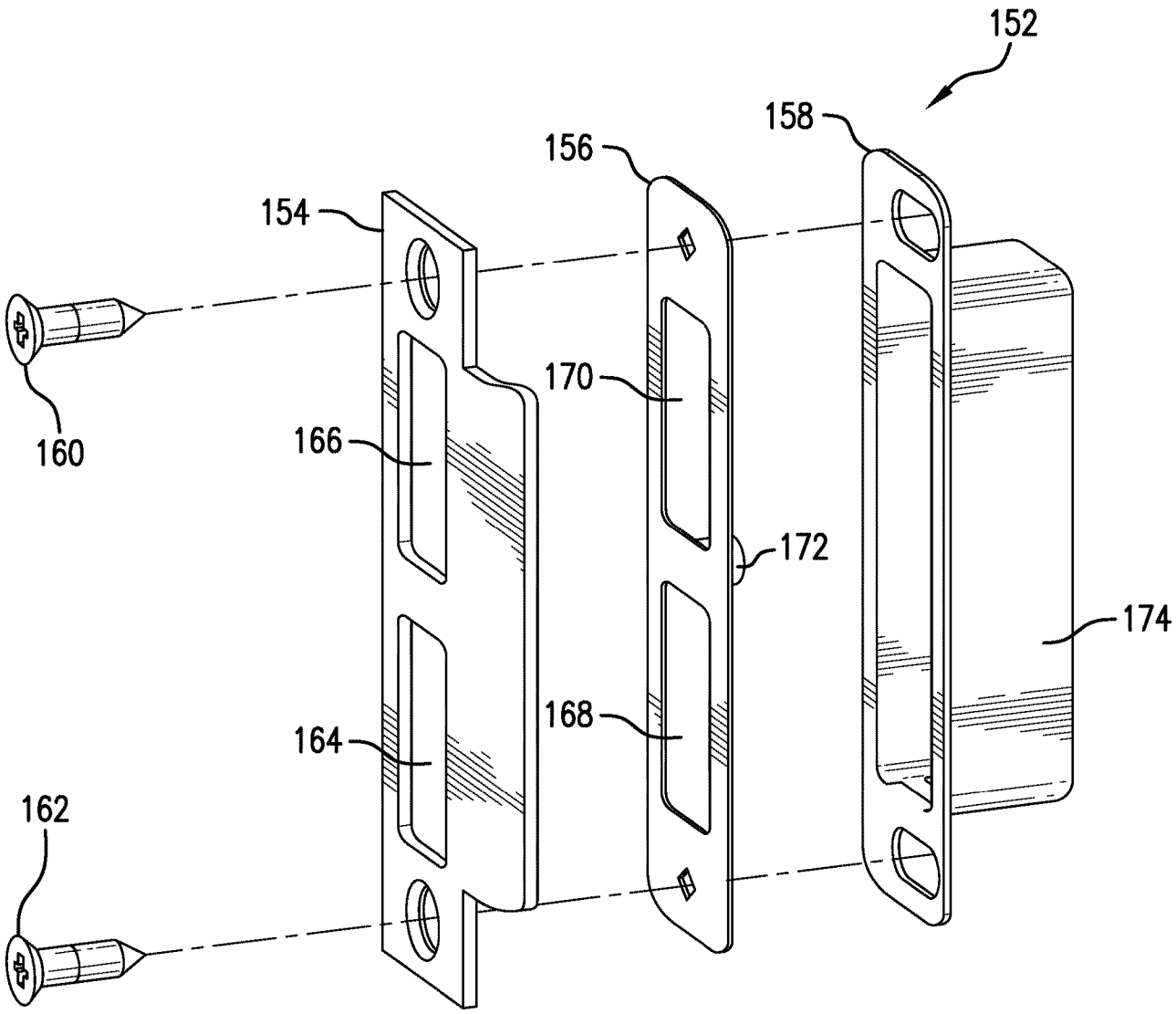
FIG. 3 is an exploded view of a door strike assembly with a magnet holder configured to engage the lock assembly of FIG. 1.

In conventional mortise lock assemblies, the magnetic field sensing device is positioned on the PCBA of the controller 130 and the magnetic field generating device 172 is positioned on the door strike as shown in FIG. 3. In doing so, the magnetic field sensing device conventionally positioned on the controller 130 may be a closed distance of the controller 130 from the magnetic field generating device 172 positioned on the door strike when the door 102 is in the closed position such that the closed distance is the distance from the controller 130 to the latch assembly 110 when the latch assembly 110 engages the door strike when the door 102 is in the closed position. Despite being the closed distance from the controller 130 to the latch assembly 110 when the door 102 is in the closed position, the significant amount of metal included in mortise lock assembly 100 provides interference with regard to the magnetic field generated by the magnetic field generating device 172 positioned on the door strike and the magnetic field sensing device conventionally positioned on the controller 130.

The interference generated by the metal of the lock assembly 100 prevents the magnetic field sensing device conventionally positioned on the controller 130 from adequately detecting the magnetic field generated by the magnetic field generating device 172 positioned on the door strike. In doing so, the magnetic field sensing device conventionally positioned on the controller 130 fails to detect the magnetic field generated by the magnetic field generating device 172 when in the closed position and thus fails to indicate to the controller 130 that the door 102 is in the closed position. Rather, the magnetic field sensing device incorrectly indicates to the controller 130 that the door 102 is in the open position due to the magnetic field sensing device failing to detect the magnetic field generated by the magnetic field generating device 172 despite the door being in the closed position due to the interference caused by the metal of the lock assembly 100. Thus, the controller 130 may incorrectly determine that the door 102 is in the open position when the door 102 is actually in the closed position due to the magnetic field sensing device conventionally positioned on the controller 130 failing to detect the magnetic field generated by the magnetic field generating device 172 as positioned on the door strike due to the interference caused by the metal of the lock assembly 100.

In other conventional mortise lock assemblies, the auxiliary latch assembly 114 is removed from the mortise lock assembly 100 and the magnetic field sensing device is positioned where the auxiliary latch assembly 114 would have been positioned. The magnetic field generating device is then conventionally positioned on the door strike such that the magnetic field generating device is aligned with the magnetic field sensing device positioned in the space previously occupied by the auxiliary latch assembly 114. In doing so, the metal of the lock assembly that was previously in between the magnetic field sensing device conventionally positioned on the controller 130 and the magnetic field generating device 172 positioned on the door strike is no longer so. The conventional positioning of the magnetic field sensing device in the position of the auxiliary latch assembly 114 and the conventional positioning of the magnetic field generating device on the door strike as aligned with the magnetic field sensing device enables the magnetic field sensing device to adequately detect the magnetic field generated by the magnetic field sensing device when the door 102 is in the closed position.

However, such conventional positioning of the magnetic field sensing device in the position of the auxiliary latch assembly 114 prevents the lock assembly 100 from having an auxiliary latch feature and thus prevents the user from having the extra protection of an auxiliary latch 118 in addition to the main latch bolt 112. Further, the conventional positioning of the magnetic field sensing device on the door strike such that the magnetic field sensing device is aligned with the previous position of the auxiliary latch assembly 114 where the magnetic field sensing device is conventionally positioned requires additional door prep by the installer. In doing so, the installer is required to drill additional holes in the door strike and to adequately secure the magnetic field generating device in the door strike such that the magnetic field generating device is adequately aligned with the previous position of the auxiliary latch assembly and thereby aligned with the magnetic field sensing device positioned where the auxiliary latch assembly 114 was previously positioned. The additional door prep prevents the installer from simply removing older mortise lock assemblies and replacing with the mortise lock assembly 100.

In order to include the auxiliary latch assembly 114 while positioning the magnetic field sensing device and the magnetic field generating device to prevent interference from the metal in conventional mortise lock assemblies, the magnetic field sensing device is positioned above the auxiliary latch assembly 114 and the magnetic field generating device is positioned higher on the door strike to have the magnetic field generating device align with the magnetic field sensing device. In doing so, the metal of the lock assembly that was previously in between the magnetic field sensing device conventionally positioned on the controller 130 and the magnetic field generating device 172 positioned on the door strike is no longer so while allowing the capabilities of the auxiliary latch assembly 114 to be utilized. The conventional positioning of the magnetic field sensing device in the position above the auxiliary latch assembly 114 and the conventional positioning of the magnetic field generating device higher on the door strike as aligned with the magnetic field sensing device enables the magnetic field sensing device to adequately detect the magnetic field generated by the magnetic field sensing device when the door 102 is in the closed position while also enabling the utilization of the auxiliary latch assembly 114.

However, such conventional positioning of the magnetic field sensing device above the position of the auxiliary latch assembly 114 as well as the conventional positioning of the magnetic field sensing device higher on the door strike such that the magnetic field sensing device is aligned with the position of the magnetic field sensing device above the auxiliary latch assembly 114 requires additional door prep by the installer. In doing so, the installer is not only required to drill additional holes in the door strike to adequately secure the magnetic field generating device in the door strike but to also drill additional holes in the lock assembly 100 such that the magnetic field generating device is adequately aligned with the position of the magnetic field sensing device above the auxiliary latch assembly 114 and thereby aligned with the magnetic field sensing device. The additional door prep prevents the installer from simply removing older mortise lock assemblies and replacing with the mortise lock assembly 100. Further, this conventional positioning also prevents the use of a deadbolt function in the lock, thus restricting the user from the additional security of a deadbolt option.

In order to prevent interference from the metal of the of the mortise lock assembly 100 from impacting the magnetic field sensing device from adequately detecting the magnetic field generated by the magnetic field generating device 172 when the door 102 is in the closed position as well as providing the auxiliary latch assembly 114 within the mortise lock assembly 100, and eliminating any unnecessary door prep by the installers, the magnetic field sensing device may be positioned on the auxiliary latch assembly 114 and/or the latch assembly 110. In doing so, the magnetic field sensing device may be positioned such that the magnetic field sensing device is able to adequately detect the magnetic field generating device 172 as positioned on the door strike as shown in FIG. 3 when the door 102 is in the closed position. As the door 102 is in the closed position, the auxiliary latch assembly 114 and/or the latch assembly 110 may also be aligned with the magnetic field generating device 172 as positioned on the door strike without any metal or the mortise lock assembly 100 in between the magnetic field generating device 172 and the magnetic field sensing device to provide interference. Further, positioning the magnetic field sensing device on the auxiliary latch assembly 114 and/or the latch assembly 110 enables the auxiliary latch assembly 114 to be utilized as well as eliminating any unnecessary drilling of holes to properly align the magnetic field sensing device and the magnetic field generating device 172.

Auxiliary Latch Assembly

Figure 2:
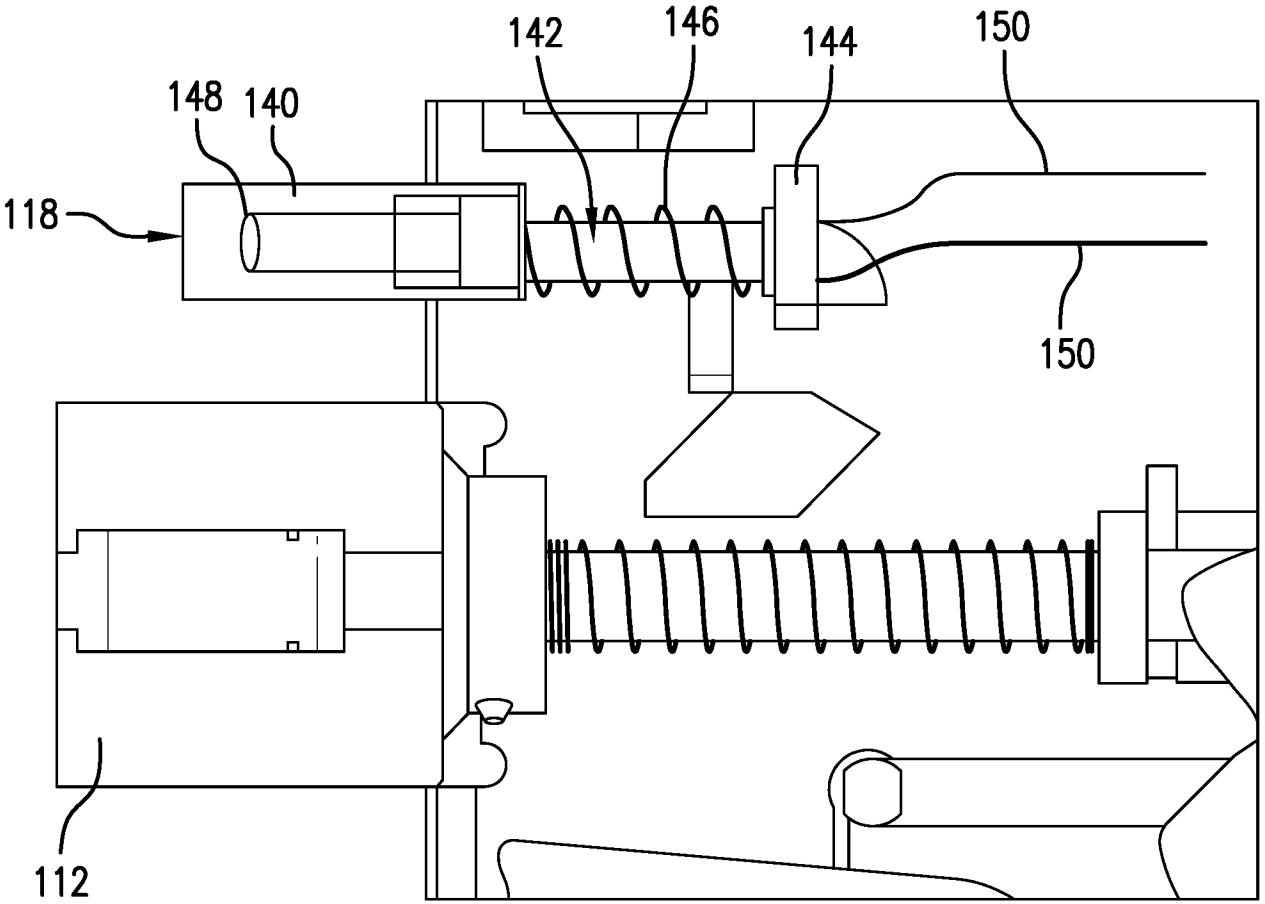
FIG. 2 is a partial view of the mortise lock assembly of FIG. 1 including an auxiliary latch assembly and a latch bolt and showing the location of a door position sensor inside an auxiliary latch assembly.

FIG. 2 illustrates a partial sectional view of the mortise lock assembly 100 of FIG. 1 including the main latch bolt 112 and the auxiliary latch 118. The auxiliary latch 118 includes an auxiliary latch plunger 140 operatively connected to an arm 142 that slidingly engages a support 144. A resilient member 146 (e.g., a spring) surrounds the arm 142 and when uncompressed, extends the plunger 140 from the case 104. In other embodiments, it should be appreciated that the resilient member 146 may be embodied as any other type of resilient member suitable to perform the functions described herein.

The plunger 140 includes a magnetic field sensing device 148, which is configured to detect a magnetic field provided by a magnetic field generating device 172, such as a permanent magnet, as further described with respect to FIG. 3.

In other embodiments, the magnetic field sensing device 148 may include one or more of different types of devices, including a reed switch or a magnetometer. A reed switch responds to a magnetic field by closing an open switch and/or opening a normally closed switch in the presence of the magnetic field. If a sensed magnetic field includes a magnetic force of sufficient magnitude, the reed switch closes to indicate that the door is in a closed position. If, however, the magnetic field is insufficient to close the reed switch, the open reed switch indicates that the door is in an open position. As such, it should be appreciated that the reed switch may be used to either open a circuit path or close a circuit path depending on the state of the switch. In a configuration using a magnetometer to determine the presence or absence of a magnetic field, the magnetometer provides an output signal having a value indicating the magnitude of the magnetic field.

The plunger 140, in some embodiments, includes a cavity of a sufficient size to accommodate the magnetic field sensing device 148. The cavity of the plunger 140, in various embodiments, is formed by removing a sufficient amount of material from a preformed single-piece plunger. In other embodiments, the cavity may be formed by a plunger 140 made of multiple parts that, when assembled, provide or define the cavity.

The magnetic field sensing device 148 may detect the magnetic field generated by the magnetic field generating device 172 when the magnetic field sensing device 148 that is positioned on the auxiliary latch assembly 114 is aligned with the magnetic field generating device 172 when the door 102 is in the closed position. The magnetic field sensing device 148 is within range of the magnetic field generating device 172 to detect the magnetic field when the magnetic field sensing device 148 is aligned with the magnetic field generating device 172 when the door 102 is in the closed position. As shown in FIG. 2, the magnetic field sensing device 148 may be positioned on the auxiliary latch 118 and the magnetic field generating device 172 may be positioned on the door strike assembly 152 as shown in FIG. 3. As the door 102 is transitioned in to the closed position, the magnetic field sensing device 148 positioned on the auxiliary latch 118 may be within sufficient distance of the magnetic field generating device 172 positioned on the door strike assembly 152 to adequately detect the magnetic field generated by the magnetic field generating device 172.

The magnetic field sensing device 148 may fail to detect the magnetic field generated by the magnetic field generating device 172 positioned on the door strike assembly 152 when the magnetic field sensing device 148 that is positioned on the auxiliary latch 118 is not aligned with the magnetic field generating device 172 when the door 102 is in the open position. The magnetic field sensing device 148 is not within range of the magnetic field generating device 172 to detect the magnetic field when the magnetic field sensing device 148 is not aligned with the magnetic field generating device 172 when the door 102 is in the open position. As the door 102 is transitioned into the open position, the magnetic field sensing device 148 positioned on the auxiliary latch 118 may no longer be within sufficient distance of the magnetic field generating device 172 positioned on the door strike assembly 152 to adequately detect the magnetic field generated by the magnetic field generating device 172.

The magnetic field sensing device 148 may indicate that the door 102 is in the closed position when the magnetic field sensing device 148 positioned on the auxiliary latch 118 is aligned with the magnetic field generating device 172 positioned on the door strike assembly 152 when the door 102 is in the closed position. The magnetic field sensing device 148 may indicate that the door 102 is in the open position when the magnetic field sensing device 148 positioned on the auxiliary latch 118 is not aligned with the magnetic field generating device 172 on the door strike assembly 152 when the door 102 is in the open position.

The magnetic field sensing device 148 may indicate to the controller 130 that the door 102 is in the closed position when the magnetic field sensing device 148 positioned on the auxiliary latch 118 is aligned with the magnetic field generating device 172 positioned on the door strike assembly 152 when the door is in the closed position. In doing so, the controller 130 may indicate to the user that the door 102 is in the closed position. For example, the controller 130 may generate an indicator displayed on the user interface 132 that provides a visual indication of the state of the door 102 with respect to the door frame. In this example, the controller 130 may generate the indicator as displayed on the user interface 132 that the door 102 is in the closed position with respect to the door frame such that the user may easily identify that the door 102 is in the closed position.

The magnetic field sensing device 148 may indicate to the controller 130 that the door 102 is in the open position when the magnetic field sensing device 148 is positioned on the auxiliary latch 118 is not aligned with the magnetic field generating device 172 on the door strike assembly 152 when the door is in the open position. In doing so, the controller 130 may indicate to the user that the door 102 is in the open position. For example, the controller 130 may generate the indicator as displayed on the user interface 132 that the door 102 is in the open position with respect to the door frame such that the user may easily identify that the door 102 is in the open position.

The magnetic field sensing device 148 may detect the magnetic field generated by the magnetic field generating device 172 when the auxiliary latch assembly 114 transitions the auxiliary latch 118 from a retracted position to an engaged position. The magnetic field sensing device 148 may be positioned on the auxiliary latch assembly 114 such that the magnetic field sensing device 148 may be aligned with the magnetic field generating device 172 when the auxiliary latch 118 is in the engaged position and the retracted position when the door 102 is in the closed position.

As shown in FIG. 2, the magnetic field sensing device 148 may be positioned on the auxiliary latch assembly 114 and the magnetic field generating device 172 may be positioned on the door strike assembly 152 as shown in FIG. 3. In positioning the magnetic field generating device 172 on the door strike assembly 152 as shown in FIG. 3 such that the magnetic field generating device 172 is aligned with the auxiliary latch assembly 114 when the door 102 is in the closed position, the magnetic field sensing device 148 may be within sufficient range to detect the magnetic field generated by the magnetic field generating device 172 regardless as to whether the auxiliary latch 118 is retracted or engaged such that the auxiliary latch 118 rests on the door strike assembly 152 when the auxiliary latch 118 is in the position. The magnetic field sensing device 148 may indicate that the door 102 is in the closed position when the auxiliary latch 118 is in the closed position and when the auxiliary latch is in the retracted position. In doing so, the magnetic field sensing device 148 may correctly indicate that the door 102 is in the closed position despite whether the user transitions the auxiliary latch 118 into the engaged position and/or the retracted position.

In an embodiment, the controller 130 may be coupled to the magnetic field sensing device 148 via a set of wires 150 that move with the arm 142 when the arm 142 moves. The set of wires 150 may slide with the arm 142 as the auxiliary latch assembly 114 moves between the retracted position and the engaged position thereby maintaining an electrical connection between the controller 130 and the magnetic field sensing device 148. The maintaining of the electrical connection between the controller 130 and the magnetic field sensing device 148 may enable the magnetic field sensing device 148 to continuously indicate to the controller 130 the status of the door 102 regarding whether the door 102 is in the open position or the closed position. In doing so, the controller 130 may continuously display to the user the current status of the door 102 regarding whether the door 102 is in the open position or the closed position.

In an embodiment, the controller 130 may be coupled to the magnetic field sensing device via an electrical contact such that the electrical contact moves with the arm 142 when the arm 142 moves. The electrical contact may slide with the arm 142 as the auxiliary latch assembly 114 moves between the retracted position and the engaged position thereby maintaining an electrical connection between the controller 130 and the magnetic field sensing device 148. The maintaining of the electrical connection between the controller 130 and the magnetic field sensing device 148 may enable the magnetic field sensing device 148 to continuously indicate to the controller 130 the status of the door 102 regarding whether the door 102 is in the open position or the closed position. In doing so, the controller 130 may continuously display to the user the current status of the door 102 regarding whether the door 102 is in the open position or the closed position.

The mortise lock assembly 100 is configured to engage a door strike assembly 152 illustrated in FIG. 3. The illustrative door strike assembly 152 includes a strike plate 154, a magnet tray 156, and a strike housing 158. The door strike assembly 152 is located in a cavity or pocket of a door frame and held in place with a first connector 160 and a second connector 162. In the illustrated embodiment, the door strike assembly 152 includes a first aperture 164 configured to receive the main latch bolt 112 and a second aperture 166 configured to receive an optional deadbolt and the auxiliary latch rests on the bar between the first aperture 164 and the second aperture 166. The magnet tray 156 includes apertures 168 and 170 aligned with the apertures 164 and 166 configured to receive the latch bolt and a deadbolt. The magnet tray 156 further includes a magnetic field generating device 172, or magnet 172, which is held by the magnet tray 156. In some embodiments, the magnet tray 156 includes a sleeve defining a cavity configured to hold the magnet 172. The magnet tray 156 may be formed of thermoformed plastic material and may be securely held between the strike plate 154 and the magnet tray 156 when assembled and located at the door frame. However, it should be appreciated that the magnet tray 156 may be formed of other materials suitable for the structural and functional aspects of the magnet tray 156 described herein. For example, the magnet tray 156 and the strike housing 158 may be generated as a single piece, thus the strike housing 158 may include a feature to hold the magnet 172. The magnet tray 156, in various embodiments, may be used with preexisting door strike plates and preexisting door strike housings. The door strike housing 158 includes a well 174 configured to receive the latch bolt and deadbolt when extended from the door lock assembly 100. The well 174 is also known as a "dust box."

By locating the magnet 172 in the door strike, no additional door preparation is required, since the magnet is hidden behind the door strike plate 154. Consequently, the magnet 172 is completely hidden for better aesthetics. As can be seen in FIG. 3, the magnet 172 is located behind a center bar of the door strike plate 154, thereby reducing any door gap preparation time when installing and setting up a door (e.g., since the assembly 152 is installed as a unit). The auxiliary latch plunger 140 is consequently, located at and against the center bar of the strike plate 154 when the door is closed, as further illustrated in FIG. 4.

Figure 4:
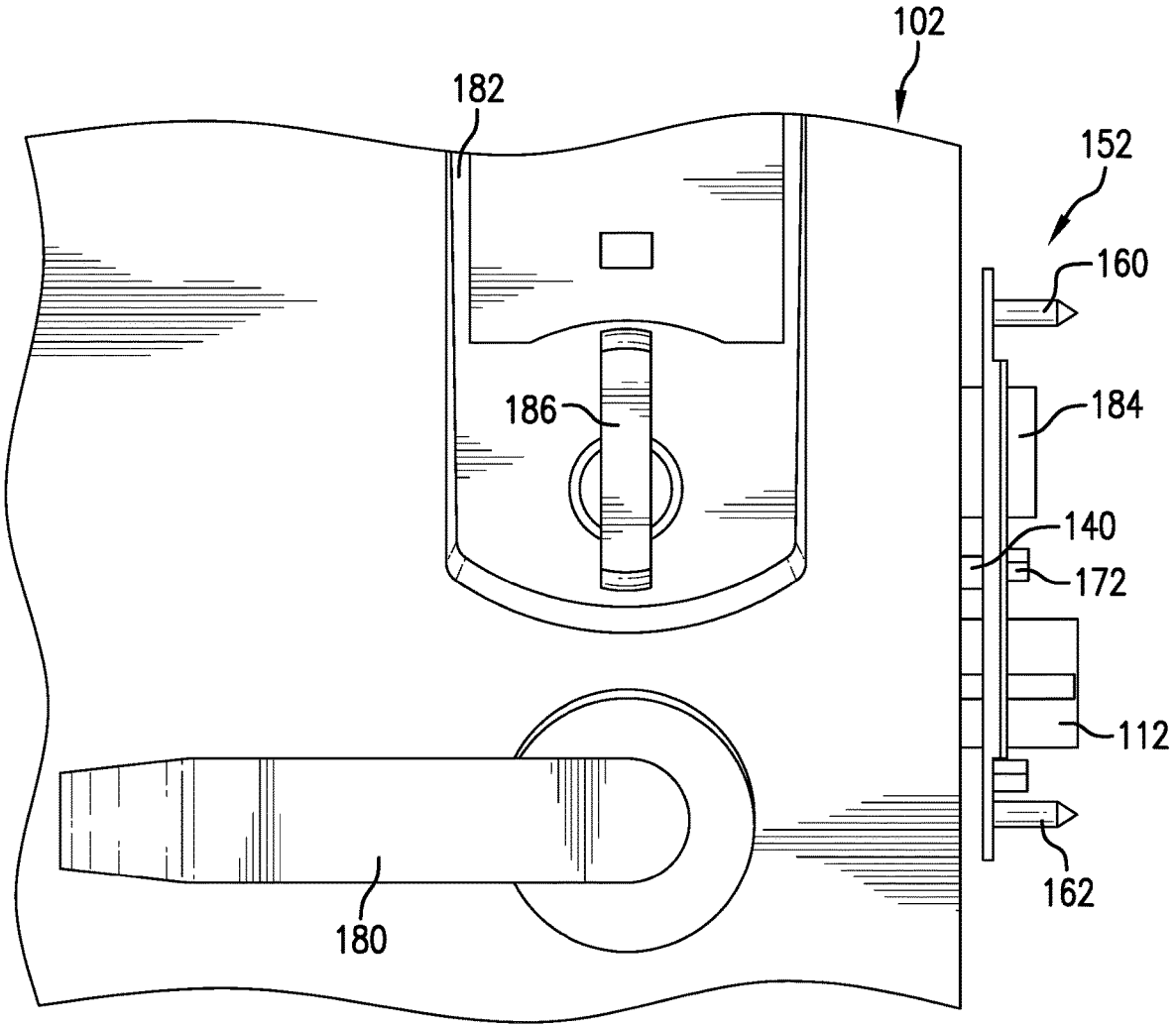
FIG. 4 is a partial front view of a door including a mortise lock assembly of FIG. 2 located within a cavity of a door.

As further illustrated in FIG. 4, the door 102, not only supports the door lock assembly 100 within a cavity of the door 102, but further provides support for a door handle 180 and a deadbolt latch mechanism 182. In the illustrative embodiment, the lock assembly 100 includes a deadbolt latch 184 which can be extended toward and retracted from the door strike assembly 152 with a handle 186. When the door 102 is in the closed position, the auxiliary latch plunger 140 and, consequently, the magnetic field sensing device 148, are located in close proximity to the magnet 172. The magnetic field sensing device 148 senses the magnetic field provided by the magnet 172 and generates a signal indicating the door is in the closed position. Although the illustrated embodiment shows both the magnet 172 and the auxiliary latch plunger 140 on substantially the same horizontal plane, in other embodiments, the magnet 172 and the plunger 140 may be offset with respect to one another along a horizontal plane.

Main Latch Assembly

Figure 5:
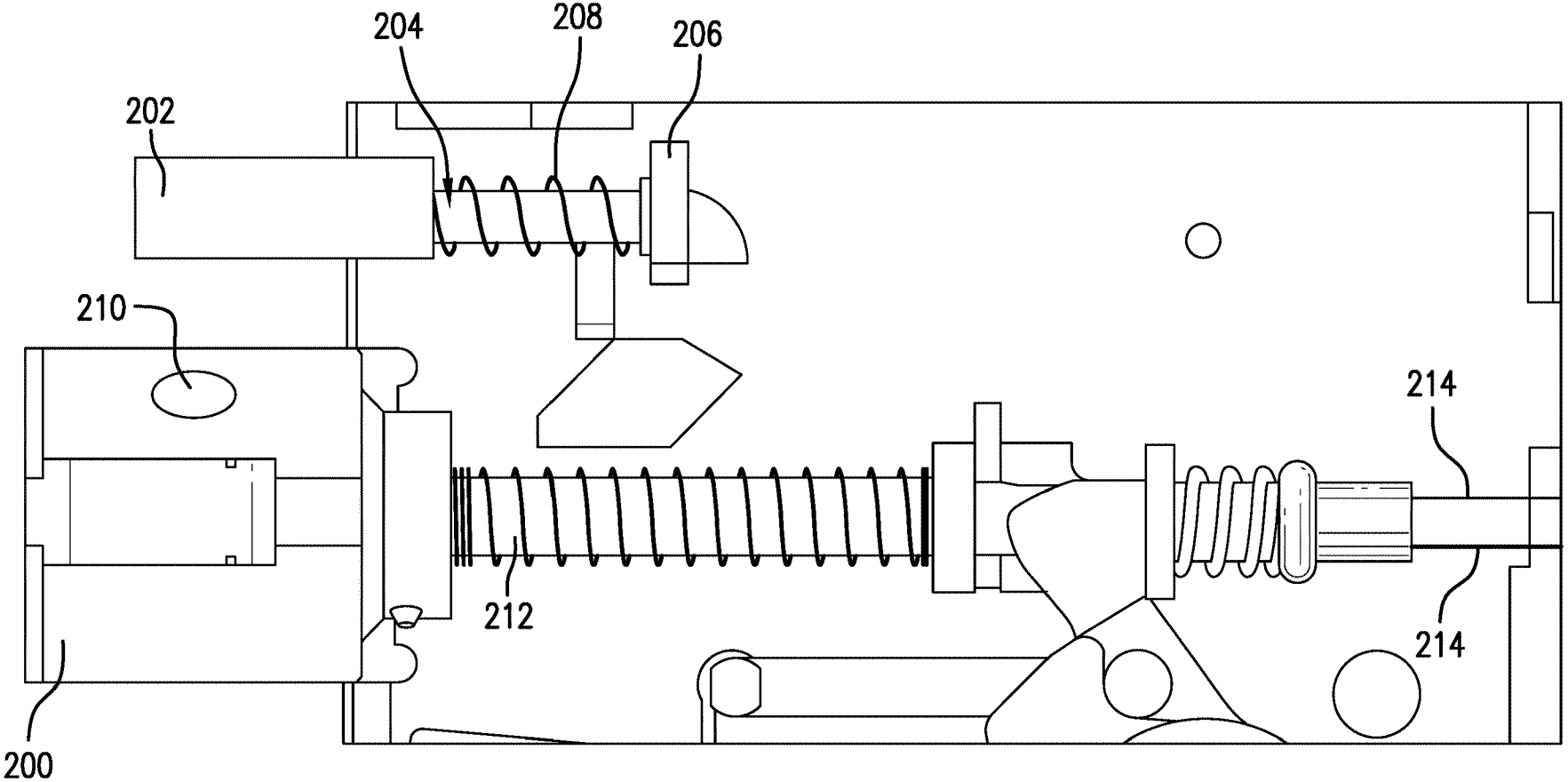
FIG. 5 is a partial view of another embodiment of the mortise lock assembly including an auxiliary latch assembly and a latch bolt and showing location of door position sensor inside the latch bolt.

FIG. 5 illustrates a partial sectional view of another embodiment of a mortise lock assembly including a main latch bolt 200 and an auxiliary latch plunger 202. The auxiliary latch plunger 202 is operatively connected to an arm 204 that slidingly engages a support 206. A resilient member 208 (e.g., a spring) surrounds the arm 204 and when uncompressed, extends the auxiliary latch plunger 202 from the case 104.

Figure 6:
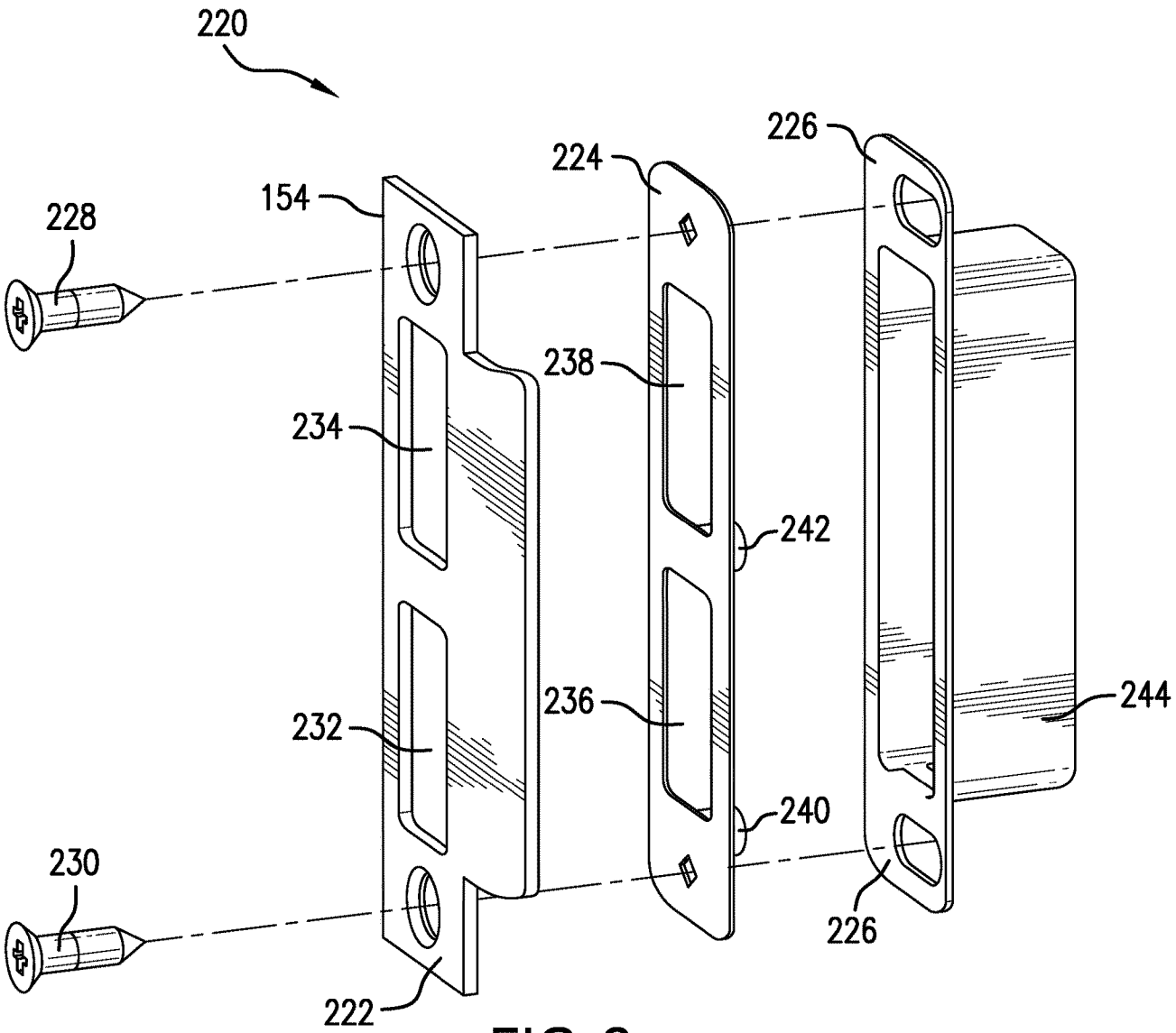
FIG. 6 is an exploded view of a door strike assembly with magnet holder configured to engage the lock assembly of FIG. 5.

In this embodiment, the main latch bolt 200 includes a magnetic field sensing device 210, which is configured to detect a magnetic field provided by one or more magnetic field generating devices, such as a permanent magnet or magnets, as further described with respect to FIG. 6. In various embodiments, the magnetic field sensing device includes one or more of different types of devices including a reed switch or a magnetometer as described above with respect to FIG. 2.

In this embodiment, the main latch bolt 200 includes a cavity having a sufficient size to accommodate the magnetic field sensing device 210. The cavity of the main latch bolt 200, in various embodiments, is formed by removing a sufficient amount of material from a preformed single-piece main latch. In other embodiments, the cavity may be formed in the main latch bolt 200 by multiple parts that, when assembled, provide the cavity.

The magnetic field sensing device 210 may detect the magnetic field generated by the magnetic field generating devices 242 or 240 when the magnetic field sensing device 210 that is positioned on the main latch bolt 210 is aligned with the magnetic field generating devices 242 or 240 when the door 102 is in the closed position. The positioning of the two magnetic field generating devices 242 and 240 enables the magnetic field sensing device 210 to detect the magnetic field generated field generated by the magnetic field generating device 242 or 240 based on the magnetic field generating device 242 or 240 that is positioned closer to the magnetic field sensing device 210 based on the positioning of the main latch bolt 210. In doing so, an installer may rotate the main latch bolt 180 degrees and the magnetic field sensing device 210 may still adequately detect the magnetic field generated by the magnetic field generating device 242 or 240. The magnetic field sensing device 210 is within range of the magnetic field generating devices 242 or 240 to detect the magnetic field when the magnetic field sensing device 172 is aligned with the magnetic field generating device 242 or 240 when the door 102 is in the closed position. As shown in FIG. 5, the magnetic field sensing device 210 may be positioned on the main latch bolt 200 and the magnetic field generating devices 242 and 240 may be positioned on the door strike assembly 220 as shown in FIG. 6. As the door 102 is transitioned in to the closed position, the magnetic field sensing device 210 positioned on the main latch bolt 200 may be within sufficient distance of the magnetic field generating devices 242 or 240 positioned on the door strike assembly 220 to adequately detect the magnetic field generated by the magnetic field generating devices 242 and 240.

The magnetic field sensing device 210 may fail to detect the magnetic field generated by the magnetic field generating devices 240 or 242 positioned on the door strike assembly 220 when the magnetic field sensing device 210 that is positioned on the main latch bolt 200 is not aligned with the magnetic field generating devices 242 or 240 when the door 102 is in the open position. The magnetic field sensing device 210 is not within range of the magnetic field generating devices 240 or 242 to detect the magnetic field when the magnetic field sensing device 210 is not aligned with the magnetic field generating devices 240 or 242 when the door 102 is in the open position. As the door 102 is transitioned into the open position, the magnetic field sensing device 210 positioned on the main latch bolt 200 may no longer be within sufficient distance of the magnetic field generating device 240 or 242 positioned on the door strike assembly 220 to adequately detect the magnetic field generated by the magnetic field generating device 240 or 242.

The magnetic field sensing device 210 may indicate that the door 102 is in the closed position when the magnetic field sensing device 210 positioned on the main latch bolt 200 is aligned with the magnetic field generating devices 240 or 242 positioned on the door strike assembly 220 when the door 102 is in the closed position. The magnetic field sensing device 210 may indicate that the door 102 is in the open position when the magnetic field sensing device 210 positioned on the main latch bolt 200 is not aligned with the magnetic field generating devices 240 or 242 on the door strike assembly 220 when the door 102 is in the open position.

The magnetic field sensing device 210 may indicate to the controller 130 that the door 102 is in the closed position when the magnetic field sensing device 210 positioned on the main latch bolt 200 is aligned with the magnetic field generating devices 240 or 242 positioned on the door strike assembly 220 when the door 102 is in the closed position. In doing so, the controller 130 may indicate to the user that the door 102 is in the closed position. For example, the controller 130 may generate an indicator displayed on the user interface 132 that provides a visual indication of the state of the door 102 with respect to the door frame. In this example, the controller 130 may generate the indicator as displayed on the user interface 132 that the door 102 is in the closed position with respect to the door frame such that the user may easily identify that the door 102 is in the closed position.

The magnetic field sensing device 210 may indicate to the controller 130 that the door 102 is in the open position when the magnetic field sensing device 210 is positioned on the main latch bolt 200 is not aligned with the magnetic field generating devices 240 or 242 on the door strike assembly 220 when the door 102 is in the open position. In doing so, the controller 130 may indicate to the user that the door 102 is in the open position. For example, the controller 130 may generate the indicator as displayed on the user interface 132 that the door 102 is in the open position with respect to the door frame such that the user may easily identify that the door 102 is in the open position.

The magnetic field sensing device 210 may detect the magnetic field generated by the magnetic field generating devices 240 or 242 when the main latch bolt 200 transitions from a retracted to an engaged position. The magnetic field sensing device 210 may be positioned on the main latch bolt 200 such that the magnetic field sensing device 210 may be aligned with the magnetic field generating devices 240 or 242 when the main latch bolt 200 is in the engaged position and the retracted position when the door 102 is in the closed position.

As shown in FIG. 5, the magnetic field sensing device 210 may be positioned on the main latch bolt 200 and the magnetic field generating devices 240 and 242 may be positioned on the door strike assembly 220 as shown in FIG. 6. In positioning the magnetic field generating devices 240 and 242 on the door strike assembly 220 as shown in FIG. 6 such that the magnetic field generating devices 240 and 242 are aligned with the main latch bolt 200 when the door 102 is in the closed position, the magnetic field sensing device 210 may be within sufficient range to detect the magnetic field generated by the magnetic field generating devices 240 or 242 regardless as to whether the main latch bolt 200 is in the engaged position and/or the retracted position. The magnetic field sensing device 210 may indicate that the door 102 is in the closed position when the main latch bolt 200 is in the closed position and when the main latch bolt is in the retracted position. In doing so, the magnetic field sensing device 210 may correctly indicate that the door 102 is in the closed position despite whether the user transitions the main latch bolt 200 into the engaged position and/or the retracted position.

In an embodiment, the controller 130 may be coupled to the magnetic field sensing device 210 via a set of wires 214 that move with the rod 212 when the rod 212 moves. The set of wires 214 may slide with the rod 212 as the main latch bolt 200 moves between the retracted position and the engaged position thereby maintaining an electrical connection between the controller 130 and the magnetic field sensing device 210. The maintaining of the electrical connection between the controller 130 and the magnetic field sensing device 210 may enable the magnetic field sensing device 210 to continuously indicate to the controller 130 the status of the door 102 regarding whether the door 102 is in the open position or the closed position. In doing so, the controller 130 may continuously display to the user the current status of the door 102 regarding whether the door 102 is in the open position or the closed position.

In an embodiment, the controller 130 may be coupled to the magnetic field sensing device via an electrical contact such that the electrical contact moves with the rod 212 when the rod 212 moves. The electrical contact may slide with the rod 212 as the main latch bolt 200 moves between the retracted position and the engaged position thereby maintaining an electrical connection between the controller 130 and the magnetic field sensing device 210. The maintaining of the electrical connection between the controller 130 and the magnetic field sensing device 210 may enable the magnetic field sensing device 210 to continuously indicate to the controller 130 the status of the door 102 regarding whether the door 102 is in the open position or the closed position. In doing so, the controller 130 may continuously display to the user the current status of the door 102 regarding whether the door 102 is in the open position or the closed position.

In an embodiment, the main latch bolt 200 is configured to engage a door strike assembly 220 as illustrated in FIG. 6. The door strike assembly 220 includes a strike plate 222, a magnet tray 224, and a strike housing 226. The door strike assembly 220 is located in a cavity or pocket of a door frame and held in place with a first connector 228 and a second connector 230. In the illustrated embodiment, the strike plate 222 includes a first aperture 232 configured to receive the latch bolt 200 and a second aperture 234 configured to receive a deadbolt. The magnet tray 224 includes apertures 236 and 238 aligned with the apertures 232 and 234 configured to receive the latch bolt and deadbolt.

The magnet tray 224 further includes a first magnetic field generating device 240 and a second magnetic field generating device 242, which are held by the magnet tray 224. In some embodiments, the magnet tray 224 includes first and second sleeves each defining a cavity configured to hold the magnets 240 and 242. The magnet tray 224 may be formed of thermoformed plastic material and may be securely held between the strike plate 222 and the magnet housing 226 when assembled and located at the door frame. However, it should be appreciated that the magnet tray 224 may be formed of other materials suitable for the structural and functional aspects of the magnet tray 156 described herein. The door strike housing 226 includes a well 244 configured to receive the latch bolt and deadbolt when engaged from the door lock assembly 100. For example, the magnet tray 224 and the door strike housing 226 may be generated as a single piece, thus the door strike housing 226 may include a feature to hold the magnets 240 and 242.

The magnetic field sensing device 210 may detect a first magnetic field generated by a first magnetic field generating device 242 positioned at a first position on the door strike assembly 220 that is above a first aperture 236 on the magnet tray 224 above where the main latch bolt 200 of the main latch device transitions through when the door 102 transitions from the open state to the closed state. The magnetic field sensing device 210 may detect a second magnetic field generated by a second magnetic field generating device 240 positioned at a second position on the door strike assembly 220 that is below the first aperture 236 on the door strike on the magnet tray 224 where the main latch bolt 200 of the main latch device transitions through when the door 102 transitions from the open state to the closed state.

In an embodiment, the first magnetic field generating device 242 and the second magnetic field generating device 240 may be positioned on the door strike assembly 220 as depicted in FIG. 6 due to the main latch bolt 200 being reversible. Depending on the direction that the door 102 swings, the main latch bolt 200 may be reversed 180 degrees to accommodate each direction that the door 102 could swing. In order to provide ease of installation and to account for whether the main latch bolt 200 is installed upright and/or reversed 180 degrees, both the first magnetic field generating device 240 and the second magnetic field generating device 242 may be positioned above and below the first aperture 236 of the magnet tray 224.

The magnetic field sensing device 210 may be positioned at a first position on the main latch bolt 200. The first position of the magnetic field sensing device 210 on the main latch bolt 200 may be closer to the first magnetic field generating device 240 than the second magnetic field generating device 242 when the main latch bolt 200 is installed in a first position. The first position of the magnetic field sensing device 210 on the main latch bolt 200 may then be closer to the second magnetic field generating device 242 than the first magnetic field generating device 240 when the main latch bolt 200 is rotated 180 degrees and is installed in a second position. Regardless as to whether the main latch bolt 200 is installed in the first position and/or rotated 180 degrees and installed in the second position, the magnetic field generating device 210 installed in the first position on the main latch bolt 200 may within sufficient range to detect the magnetic field generated by the first magnetic field generating device 240 and/or the second magnetic field generating device 242 when the door 102 is in the closed position.

Figure 7:
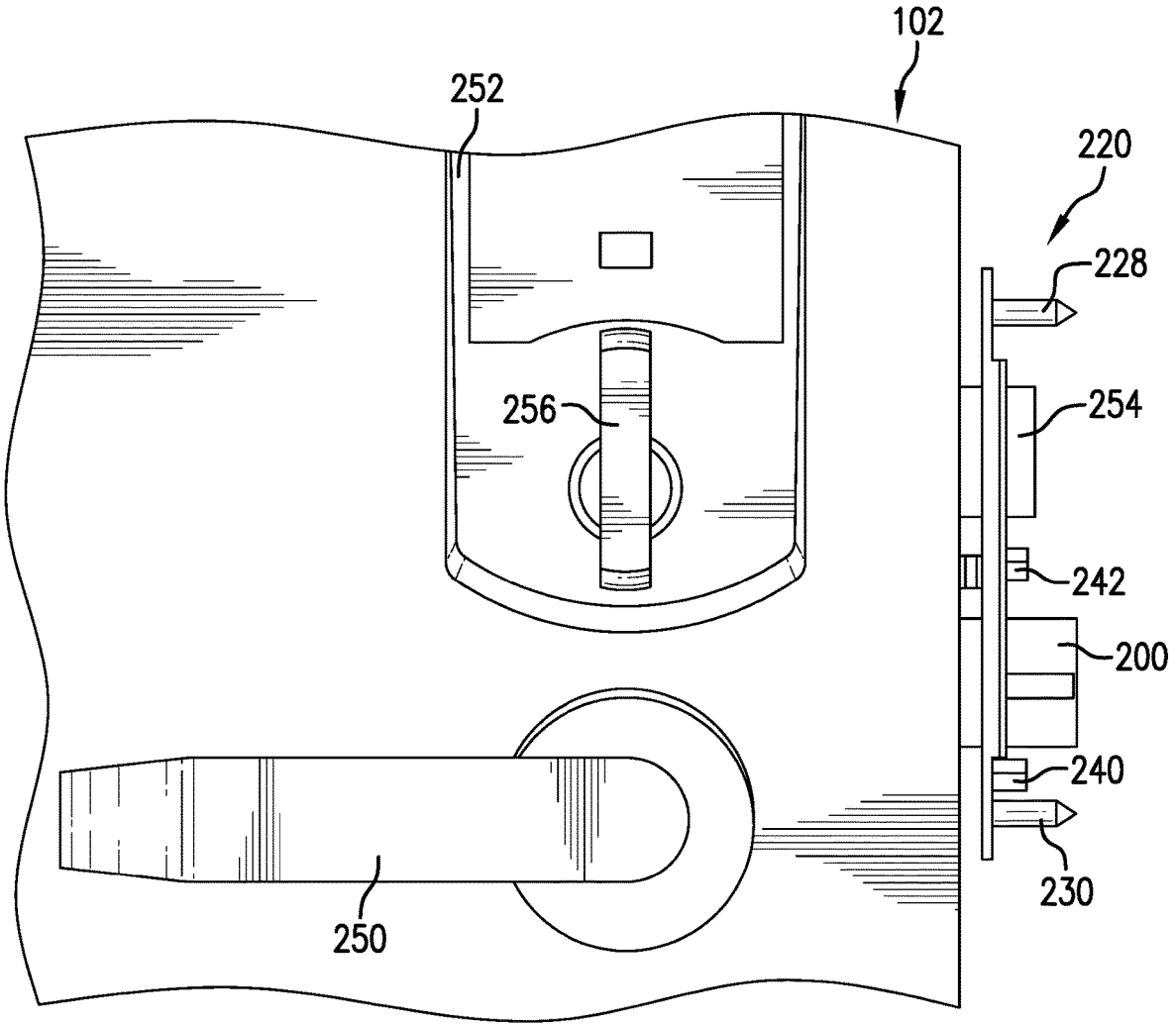
FIG. 7 is a partial front view of a door including the mortise lock assembly of FIG. 5 located within a cavity of a door.

In FIG. 7, the door 102 supports the door lock assembly 100 within a cavity of the door 102 and provides support for a door handle 250 and a deadbolt latch mechanism 252. In this embodiment, the lock assembly 100 includes a deadbolt latch 254, which can be extended toward and retracted from the door strike assembly 220 with a handle 256. When the door 102 is in the closed position, the main latch bolt 200, and consequently, the magnetic field sensing device 210, extends between the magnets 240 and 242. The magnetic field sensing device 210 senses the magnetic field provided by the magnets 240 or 242 and generates a signal indicating the door 102 is in the closed position. Although the illustrated embodiment shows both the magnets 240 and 242 disposed on either side of the main latch bolt 200, in other embodiments, the magnets 240 and 242 may be located at other positions with respect to the main latch bolt 200. In some embodiments, only one of the magnets 240 and 242 is present and the other magnet is not used.

The present disclosure provides a door position sensor for a mortise, which in one embodiment, utilizes an existing auxiliary latch or main latch modified to include a magnetic field sensor. No or little additional door preparation time is required as the magnetic field generating device (e.g., a permanent magnet) located in the door strike assembly is located and hidden behind the door strike plate.

In addition to being able to use preexisting locations for a door strike assembly, concerns regarding the gap between the strike assembly and the door lock becomes are reduced during door setup, as the auxiliary latch and therefore the sensor, is located against the door strike plate when the door is closed. No or little additional door preparation time is therefore required. When the main latch is configured to include the magnetic field sensor, concerns regarding the particular door strike material are reduced, because the sensor extends behind the door strike plate and between the magnets when the door is closed. Accordingly, in some embodiments, a stainless steel strike plate may be used.

System Overview

Figure 8:
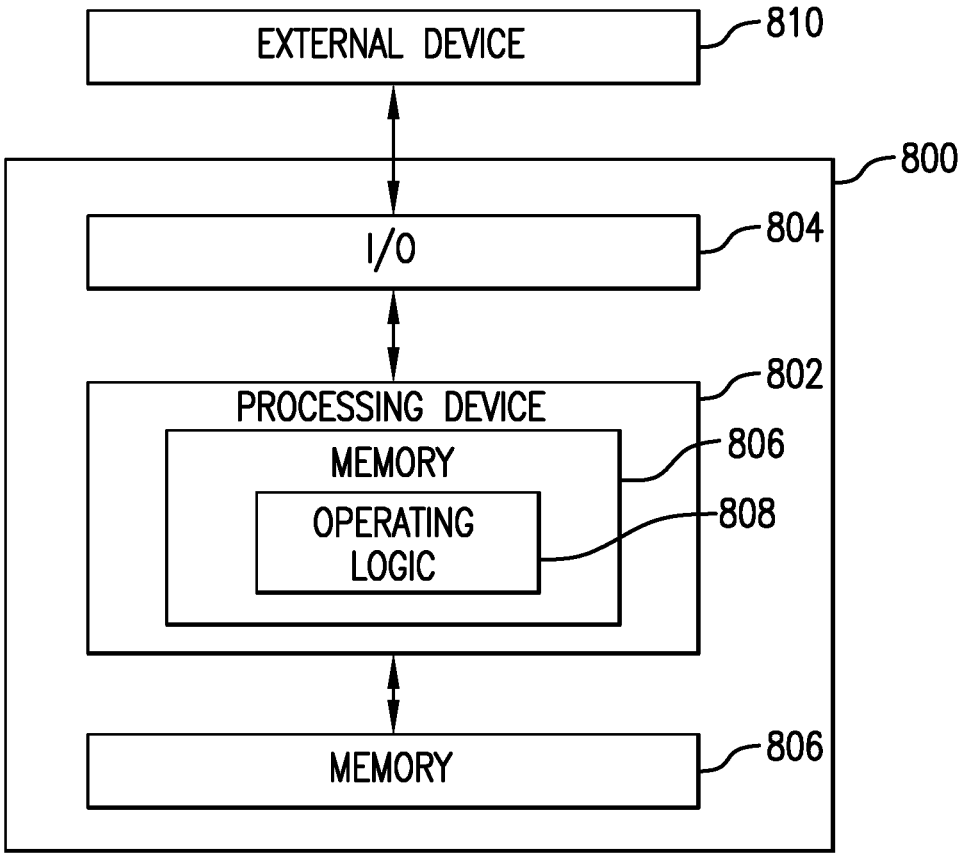
FIG. 8 illustrates a block diagram of an exemplary controller as incorporated into an exemplary mortise lock assembly.

Referring now to FIG. 8, a simplified block diagram of at least one embodiment of a computing device 800 is shown. The illustrative computing device 800 depicts at least one embodiment of a controller 130 for the mortise lock assembly 100 illustrated in FIG. 1. Depending on the particular embodiment, computing device 800 may be embodied as a reader device, credential device, door control device, access control device, server, desktop computer, laptop computer, tablet computer, notebook, netbook, Ultrabook™, mobile computing device, cellular phone, smartphone, wearable computing device, personal digital assistant, Internet of Things (IoT) device, control panel, processing system, router, gateway, and/or any other computing, processing, and/or communications device capable of performing the functions described herein.

The computing device 800 includes a processing device 802 that executes algorithms and/or processes data in accordance with operating logic 808, an input/output device 804 that enables communication between the computing device 800 and one or more external devices 810, and memory 806 which stores, for example, data received from the external device 810 via the input/output device 804.

The input/output device 804 allows the computing device 800 to communicate with the external device 810. For example, the input/output device 804 may include a transceiver, a network adapter, a network card, an interface, one or more communication ports (e.g., a USB port, serial port, parallel port, an analog port, a digital port, VGA, DVI, HDMI, FireWire, CAT 5, or any other type of communication port or interface), and/or other communication circuitry. Communication circuitry may be configured to use any one or more communication technologies (e.g., wireless or wired communications) and associated protocols (e.g., Ethernet, Bluetooth®, Wi-Fi®, WiMAX, etc.) to effect such communication depending on the particular computing device 800. The input/output device 804 may include hardware, software, and/or firmware suitable for performing the techniques described herein.

The external device 810 may be any type of device that allows data to be inputted or outputted from the computing device 800. For example, in various embodiments, the external device 810 may be embodied as controller 130 in the mortise lock assembly 100. Further, in some embodiments, the external device 810 may be embodied as another computing device, switch, diagnostic tool, controller, printer, display, alarm, peripheral device (e.g., keyboard, mouse, touch screen display, etc.), and/or any other computing, processing, and/or communications device capable of performing the functions described herein. Furthermore, in some embodiments, it should be appreciated that the external device 810 may be integrated into the computing device 800.

The processing device 802 may be embodied as any type of processor(s) capable of performing the functions described herein. In particular, the processing device 802 may be embodied as one or more single or multi-core processors, microcontrollers, or other processor or processing/controlling circuits. For example, in some embodiments, the processing device 802 may include or be embodied as an arithmetic logic unit (ALU), central processing unit (CPU), digital signal processor (DSP), and/or another suitable processor(s). The processing device 802 may be a programmable type, a dedicated hardwired state machine, or a combination thereof. Processing devices 802 with multiple processing units may utilize distributed, pipelined, and/or parallel processing in various embodiments. Further, the processing device 802 may be dedicated to performance of just the operations described herein, or may be utilized in one or more additional applications. In the illustrative embodiment, the processing device 802 is of a programmable variety that executes algorithms and/or processes data in accordance with operating logic 808 as defined by programming instructions (such as software or firmware) stored in memory 806. Additionally or alternatively, the operating logic 808 for processing device 802 may be at least partially defined by hardwired logic or other hardware. Further, the processing device 802 may include one or more components of any type suitable to process the signals received from input/output device 804 or from other components or devices and to provide desired output signals. Such components may include digital circuitry, analog circuitry, or a combination thereof.

The memory 806 may be of one or more types of non-transitory computer-readable media, such as a solid-state memory, electromagnetic memory, optical memory, or a combination thereof. Furthermore, the memory 806 may be volatile and/or nonvolatile and, in some embodiments, some or all of the memory 806 may be of a portable variety, such as a disk, tape, memory stick, cartridge, and/or other suitable portable memory. In operation, the memory 806 may store various data and software used during operation of the computing device 800 such as operating systems, applications, programs, libraries, and drivers. It should be appreciated that the memory 806 may store data that is manipulated by the operating logic 808 of processing device 802, such as, for example, data representative of signals received from and/or sent to the input/output device 804 in addition to or in lieu of storing programming instructions defining operating logic 808. As shown in FIG. 8, the memory 806 may be included with the processing device 802 and/or coupled to the processing device 802 depending on the particular embodiment. For example, in some embodiments, the processing device 802, the memory 806, and/or other components of the computing device 800 may form a portion of a system-on-a-chip (SoC) and be incorporated on a single integrated circuit chip.

In some embodiments, various components of the computing device 800 (e.g., the processing device 802 and the memory 806) may be communicatively coupled via an input/output subsystem, which may be embodied as circuitry and/or components to facilitate input/output operations with the processing device 802, the memory 806, and other components of the computing device 800. For example, the input/output subsystem may be embodied as, or otherwise include, memory controller hubs, input/output control hubs, firmware devices, communication links (i.e., point-to-point links, bus links, wires, cables, light guides, printed circuit board traces, etc.) and/or other components and subsystems to facilitate the input/output operations.

The computing device 800 may include other or additional components, such as those commonly found in a typical computing device (e.g., various input/output devices and/or other components), in other embodiments. It should be further appreciated that one or more of the components of the computing device 800 described herein may be distributed across multiple computing devices. In other words, the techniques described herein may be employed by a computing system that includes one or more computing devices. Additionally, although only a single processing device 802, I/O device 804, and memory 806 are illustratively shown in FIG. 8, it should be appreciated that a particular computing device 500 may include multiple processing devices 802, I/O devices 804, and/or memories 806 in other embodiments. Further, in some embodiments, more than one external device 810 may be in communication with the computing device 800.

Access Control Device System Overview

Figure 9:
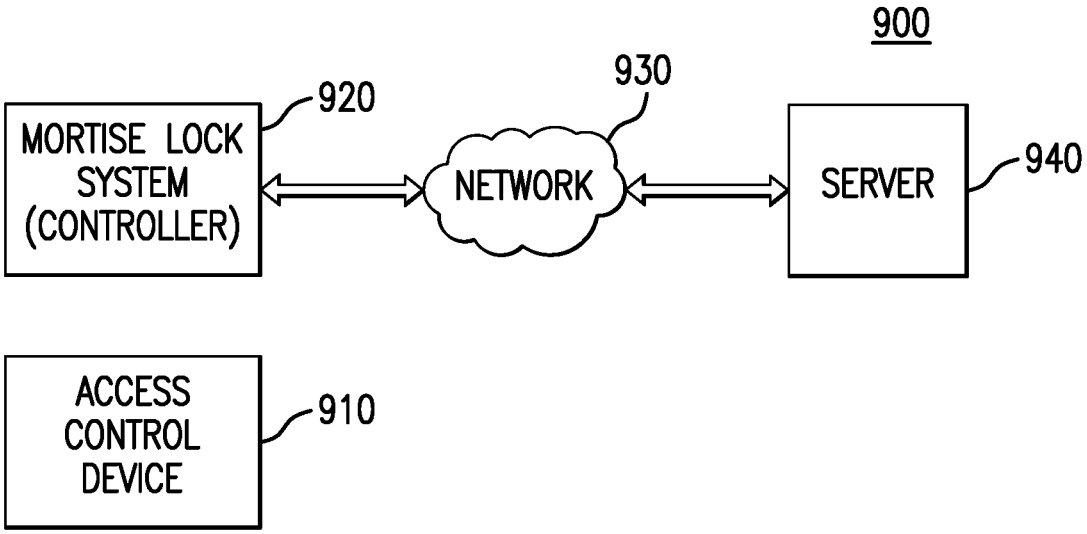
FIG. 9 illustrates a block diagram of an exemplary access control device configuration that incorporates the mortise lock systems.

FIG. 9 is a block diagram of an exemplary access control device configuration 900 that incorporates the mortise lock assemblies discussed in detail above. For example, the access control device configuration 900 may incorporate the mortise lock assembly 100 into the mortise lock system 920 which operates as the controller for the access control device 910. In doing so, the mortise lock system 920 as operating as the controller of the access control device 910 may control one or more components of the access control device 910 as the access control device 910 operates. For example, the access control device 910 may be a locking system and the mortise lock system 920 determine when the door latch of the locking mechanism included in the access control device 910 is to extend when the access control device 910 is to be locked and when the door latch is to retract when the access control device 910 is to be unlocked.

The access control device 910 that the mortise lock system 920 may act as the controller for may include but is not limited to door closers, door operators, auto-operators, credential readers, hotspot readers, electronic locks including mortise, cylindrical, and/or tabular locks, exit devices, panic bars, wireless reader interfaces, gateway devices, plug-in devices, peripheral devices, doorbell camera systems, door closer control surveillance systems and/or any other type of access control device that regulates access control to a space that will be apparent to those skilled in the relevant art(s) without departing from the spirit and scope of the disclosure.

The mortise lock system 920 when operating as the controller for the access control device 910 may control one or more components of the access control device 910 as the access control device 910 operates such as but not limited to, extending/retracting a door latch, engaging/disengaging a dogging mechanism on an exit device, opening/closing a door via a door closer/operator, moving a primer mover, controlling an electric motor, and/or any other type of action that enables the access control device 910 to regulate the opening and/or closing of a door that provides access to a space that will be apparent to those skilled in the relevant art(s) without departing from the spirit and scope of the disclosure.

The mortise lock system 920 when operating as the controller for the access control device 910 may receive data from the access control device 910 as well any type of component included in the access control device 910 that may provide data to the mortise lock system 920 for the mortise lock system 920 to adequately instruct the access control device 910 as to how to operate to adequately regulate how the door opens and/or closes to provide access to the space.

For example, sensors included in a locking mechanism may send data to the mortise lock system 920 indicating that a person has departed from the door after the door closed behind the person. The mortise lock system 920 may then instruct the door latch to extend thereby locking the door. The mortise lock system 920 may receive data from any type of component included in the access control device 920 that includes but is not limited to sensors, credential readers, biometric sensing devices, user interface devices, and/or any other component that may provide data to the mortise lock system 920 to adequately instruct the access control device 910 to execute actions to regulate door closer to the space that will be apparent to those skilled in the relevant art(s) without departing from the spirit and scope of the disclosure.

The mortise lock system 920 may communicate to with the access control device 910 via wire-line communication and/or wireless communication. The mortise lock system 920 may engage in wireless communication with the access control device 910 that includes but is not limited to Bluetooth, BLE, Wi-Fi, and/or any other wireless communication protocol that will be apparent to those skilled in the relevant art(s) without departing from the spirit and scope of the disclosure. The mortise lock system 920 may communicate with the server 940 via network 930.

CONCLUSION

It is to be appreciated that the Detailed Description section, and not the Abstract section, is intended to be used to interpret the claims. The Abstract section may set forth one or more, but not all exemplary embodiments, of the present disclosure, and thus, are not intended to limit the present disclosure and the appended claims in any way.

The present disclosure has not been described above with the aid of functional building blocks illustrating the implementation of specified functions and relationships thereof. The boundaries of these functional building blocks have been arbitrarily defined herein for the convenience of the description. Alternate boundaries may be defined as long as the specified functions and relationships are appropriately performed.

It will be apparent to those skilled in the relevant art(s) that various changes in form and in detail can be made without departing from the spirit and scope of the present disclosure. Thus the present disclosure should not be limited by any of the above-described exemplary embodiments, but should be defined only in accordance with the following claims and their equivalents.

What is claimed is:

1. A mortise lock assembly associated with a door, comprising:

a main latch bolt configured to transition between an extended state and a retracted state relative to a mortise lock case, wherein the main latch is configured to maintain the door in a closed position when the main latch bolt is in the extended state;

an auxiliary latch configured to transition between a retracted position and an extended position relative to the mortise lock case, wherein the auxiliary latch is configured to deadlock the main latch bolt when the auxiliary latch is in the extended position; and a magnetic field sensing device positioned on the auxiliary latch and configured to detect a magnetic field generated by a magnetic field generating device positioned on a door strike, wherein the magnetic field sensing device on the auxiliary latch is aligned with the magnetic field generating device when the door is in the closed position.

2. The mortise lock assembly of claim 1, wherein the magnetic field sensing device is further configured to:

detect the magnetic field generated by the magnetic field generating device when the magnetic field sensing device is aligned with the magnetic field generating device when the door is in the closed position, wherein the magnetic field sensing device is within range of the magnetic field generating device to detect the magnetic field when the magnetic field sensing device is aligned with the magnetic field generating device when the door is in the closed position; and fail to detect the magnetic field generated by the magnetic generating device when the magnetic field sensing device is not aligned with the magnetic field generating device when the door is in an open position, wherein the magnetic field sensing device is not within range of the magnetic field generating device to detect the magnetic field when the magnetic field sensing device is not aligned with the magnetic field generating device when the door is in the open position.

3. The mortise lock assembly of claim 2, wherein the magnetic field sensing device is further configured to:

indicate that the door is in the closed position when the magnetic field sensing device is aligned with the magnetic field generating device when the door is in the closed position; and indicate that the door is in the open position when the magnetic field sensing device is not aligned with the magnetic field generating device when the door is in the open position.

4. The mortise lock assembly of claim 3, wherein the magnetic field sensing device is further configured to:

detect the magnetic field generated by the magnetic field generating device when the auxiliary latch transitions the auxiliary latch from the retracted position to the extended position, wherein the magnetic field sensing device is aligned with the magnetic field generating device when the auxiliary latch is in the extended position and the retracted position when the door is in the closed position.

5. The mortise lock assembly of claim 4, wherein the magnetic field sensing device is further configured to indicate that the door is in the closed position when the auxiliary latch is in the extended position and when the auxiliary latch is in the retracted position.

6. The mortise lock assembly of claim 5, further comprising:

a controller that is coupled to the magnetic field sensing device via an electrical contact, wherein the electrical contact slides with the auxiliary latch thereby maintaining an electrical connection between the controller and the magnetic field sensing device.

7. The mortise lock assembly of claim 6, further comprising:

a set of wires that couple the controller to the magnetic field sensing device, wherein the set of wires slide with the auxiliary latch thereby maintaining an electrical connection between the controller and the magnetic field sensing device.

8. A method for determining a position of a door using the mortise lock assembly of claim 1, comprising:

transitioning, by the auxiliary latch, the mortise lock assembly between a locked state and an unlocked state;

detecting, by the magnetic field sensing device, the magnetic field generated by the magnetic field generating device; and aligning the magnetic field sensing device with the magnetic field generating device when the door is in the closed position.

9. The method of claim 8, wherein the detecting comprises:

detecting the magnetic field generated by the magnetic field generating device when the magnetic field sensing device is aligned with the magnetic field generating device when the door is in the closed position, wherein the magnetic field sensing device is within range of the magnetic field generating device to detect the magnetic field when the magnetic field sensing device is aligned with the magnetic field generating device when the door is in the closed position; and failing to detect the magnetic field generated by the magnetic field generating device when the magnetic field sensing device is not aligned with the magnetic field generating device when the door is an open position, wherein the magnetic field sensing device is not within range of the magnetic field generating device to detect the magnetic field when the magnetic field sensing device is not aligned with the magnetic field generating device when the door is in the open position.

10. The method of claim 9, further comprising:

indicating, by the magnetic field sensing device, that the door is in the closed position when the magnetic field sensing device is aligned with the magnetic field generating device when the door is in the closed position; and indicating that the door is in the open position when the magnetic field sensing device is not aligned with the magnetic field generating device when the door in the open position.

11. The method of claim 10, wherein the detecting further comprises:

detecting the magnetic field generated by the magnetic field generating device when the auxiliary latch transitions from the retracted position to the extended position, wherein the magnetic field sensing device is aligned with the magnetic field generating device when the auxiliary latch is in the extended position and the retracted position when the door is in the closed position.

12. The method of claim 11, wherein the indicating comprises:

indicating that the door is in the closed position when the auxiliary latch is in the extended position and when the auxiliary latch is in the retracted position.

13. The method of claim 12, further comprising:

maintaining an electrical connection between a controller that is coupled to the magnetic field sensing device via an electrical contact which moves with the auxiliary latch.

14. The method of claim 13, wherein the maintaining comprises:

maintaining the electrical connection between the controller and the magnetic sensing device via a set of wires which move with the auxiliary latch.

15. A mortise lock assembly associated with a door, comprising:

a main latch bolt configured to transition between an extended state and a retracted state relative to a mortise lock case, wherein the main latch is configured to maintain the door in a closed position when the main latch bolt is in the extended position;

an auxiliary latch configured to transition between a retracted position and an extended position relative to the mortise lock case, wherein the auxiliary latch is configured to deadlock the main latch bolt when the auxiliary latch is in the extended position; and a magnetic field sensing device positioned on the main latch bolt and configured to detect a magnetic field generated by a magnetic field generating device positioned on a door strike, wherein the magnetic field sensing device on the main latch bolt is aligned with the magnetic field generating device when the door is in the closed position.

16. The mortise lock assembly of claim 15, wherein the magnetic field sensing device is further configured to:

detect the magnetic field generated by the magnetic field generating device when the magnetic field sensing device is aligned with the magnetic field generating device when the door is in the closed position, wherein the magnetic field sensing device is within range of the magnetic field generating device to detect the magnetic field when the magnetic field sensing device is aligned with the magnetic field generating device when the door is in the closed position; and fail to detect the magnetic field generated by the magnetic field generating device when the magnetic field sensing device is not aligned with the magnetic field generating device when the door is in an open position, wherein the magnetic field sensing device is not within range of the magnetic field generating device to detect the magnetic field when the magnetic field sensing device is not aligned with the magnetic field generating device when the door is in the open position.

17. The mortise lock assembly of claim 16, wherein the magnetic field sensing device is further configured to:

indicate that the door is in the closed position when the magnetic sensing device is aligned with the magnetic field generating device when the door is in the closed position; and indicate that the door is in the open position when the magnetic field sensing device is not aligned with the magnetic field generating device when the door is in the open position.

18. The mortise lock assembly of claim 17, wherein the magnetic field sensing device is further configured to:

detect the magnetic field generated by the magnetic field generating device when a deadbolt is transitioned from an unlocked position to a locked position, wherein the magnetic field sensing device that is positioned on the main latch bolt is aligned with the magnetic field generating device when the deadbolt is in the locked position and the unlocked position when the door is in the closed position.

19. The mortise lock assembly of claim 18, wherein the magnetic field sensing device is further configured to indicate that the door is in the closed position when the deadbolt is in the locked position and when the deadbolt is in the unlocked position.

20. The mortise lock assembly of claim 19, wherein the magnetic field sensing device is further configured to:

detect a first magnetic field generated by a first magnetic field generating device positioned at a first position on the door strike that is located above a first aperture on the door strike above where the main latch bolt transitions through when the door transitions from the open position to the closed position; and detect a second magnetic field generated by a second magnetic field generating device positioned at a second position on the door strike that is located below the first aperture on the door strike below where the main latch bolt transitions.

* * * * *